US011059578B2

(12) United States Patent
Harrington

(10) Patent No.: US 11,059,578 B2
(45) Date of Patent: Jul. 13, 2021

(54) KITE CONTROL BAR WITH INTEGRATED BACK TRIM LINE TENSIONING MEANS

(71) Applicant: Ocean Rodeo Sports Inc., Victoria (CA)

(72) Inventor: Ross D Harrington, Victoria (CA)

(73) Assignee: OCEAN RODEO SPORTS INC., Victoria (CA)

( * ) Notice: Subject to any disclaimer, the term of this patent is extended or adjusted under 35 U.S.C. 154(b) by 470 days.

(21) Appl. No.: 16/088,917

(22) PCT Filed: Oct. 19, 2016

(86) PCT No.: PCT/CA2016/051210
§ 371 (c)(1),
(2) Date: Sep. 27, 2018

(87) PCT Pub. No.: WO2017/181260
PCT Pub. Date: Oct. 26, 2017

(65) Prior Publication Data

US 2019/0112043 A1 Apr. 18, 2019

Related U.S. Application Data

(60) Provisional application No. 62/325,122, filed on Apr. 20, 2016.

(51) Int. Cl.
*B64C 31/06* (2020.01)
*B63H 8/16* (2020.01)

(52) U.S. Cl.
CPC ..... *B64C 31/06* (2013.01); *B63H 8/16* (2020.02)

(58) Field of Classification Search
CPC ..... B64C 31/06; B63B 34/60; B63B 34/63; A63H 27/002; A63H 27/04; A63H 27/08
USPC ..... 446/30–34
See application file for complete search history.

(56) References Cited

U.S. PATENT DOCUMENTS

2012/0018584 A1 1/2012 Lawson

FOREIGN PATENT DOCUMENTS

DE 10 2013 104 100 A1 10/2014
FR 2 875 788 A1 3/2006

OTHER PUBLICATIONS

International Search Report Corresponding to PCT/CA2016/051210 dated Dec. 28, 2016.
Written Opinion Corresponding to PCT/CA2016/051210 dated Dec. 28, 2016.

*Primary Examiner* — Nicholas McFall
*Assistant Examiner* — Terri L Filosi
(74) *Attorney, Agent, or Firm* — Finch & Maloney, PLLC; Michael J. Bujold

(57) ABSTRACT

A kite control bar having a tensioning member anchored to the bar end float and secured to the trim line. The tensioning member is capable of expanding and contracting. The tensioning member has a default state which is either an expanded state or a contracted state. When an adjusting force is exerted upon the trim line, the tensioning member is drawn into another of the expanded state or the contracted state. When the adjusting force is released, the tensioning member tends to return to the default state. This biases the trim line to force excess trim line out of the bar end float.

11 Claims, 14 Drawing Sheets

PRIOR ART

PRIOR ART

KITE CONTROL BAR WITH INTEGRATED BACK TRIM LINE TENSIONING MEANS

FIELD

The field of this innovation is a kite control bar used for kite boarding.

BACKGROUND

Kite control bars that are used for kite boarding have front flying lines that connect to the leading edge of the kite and back flying line that connect to the wingtips of the kite near the trailing edge. By varying the length of the back flying lines in relation to the front flying lines the angle of attack of the kite can be adjusted. Lengthening the back flying lines will lower the angle of attack of the kite thus reducing the power that the kite can produce. Shortening the back flying lines will increase the angle of attack of the kite thus increasing the power that the kite can produce.

Trim systems can be integrated into the kite control bar so that the length of the back flying lines can be adjusted by the user. These trim systems can be, but not limited to, winders, winches, ropes and cleats and any other system that allows for the length of the back flying lines to be adjusted.

When the kite is in flight the front flying lines and back flying lines are under tension so when the trim system is adjusted to reduce the power in the kite, by lengthening the back flying lines, the excess back trim line that is inside the bar and bar end floats is pulled tight out of the top of the bar end float.

When the kite is not in flight it is important for the user to be able to set the trim of the kite, for more or less power, before launching the kite into the air. Launching the kite with the incorrect power trim setting could result in an accident. When reducing the power by lengthening the trim system, the excess back trim line is not pulled out of the end of the bar end float, as the kite is not pulling on the back flying lines. As a result of this, the excess back trim line gathers inside the kite control bar and bar end float. This can potentially cause the back trim line to tangle thus disabling the trim system. As the back trim line is not pulled out of the end of the bar end float, the user is unable to tell exactly what the trim setting is before launching the kite.

SUMMARY

There is provided a kite control bar having a bar end float through which a trim line passes. A tensioning member is anchored to the bar end float and secured to the trim line. The tensioning member is capable of expanding and contracting. The tensioning member has a default state which is either an expanded state or a contracted state. When an adjusting force is exerted upon the trim line, the tensioning member is drawn into another of the expanded state or the contracted state. When the adjusting force is released, the tensioning member tends to return to the default state. This biases the trim line to force excess trim line out of the bar end float.

Adding a tensioning member that forces the excess back trim line out of the top of the bar end float, when there is no tension on the back flying lines from the kite, will prevent excess back trim line from gathering inside the kite control bar and bar end float ends. Since the excess back trim line is forced out of the top of the bar end floats, the user is able to see and gauge the trim setting before launching the kite.

The tensioning member can be an elastomeric material such as, but not limited to, shock cord, surgical tubing, elastic band or neoprene.

The tensioning member can be a compression spring made from a variety of materials such as, but not limited to, stainless steel, spring steel, plastics or nylons.

The tensioning member can be located internally inside the bar end float or externally above the top of the bar end float.

The back trim line and or the plastic tubing, that covers the back trim line, can have calibration markings so that the user can visually tell what the trim setting is.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
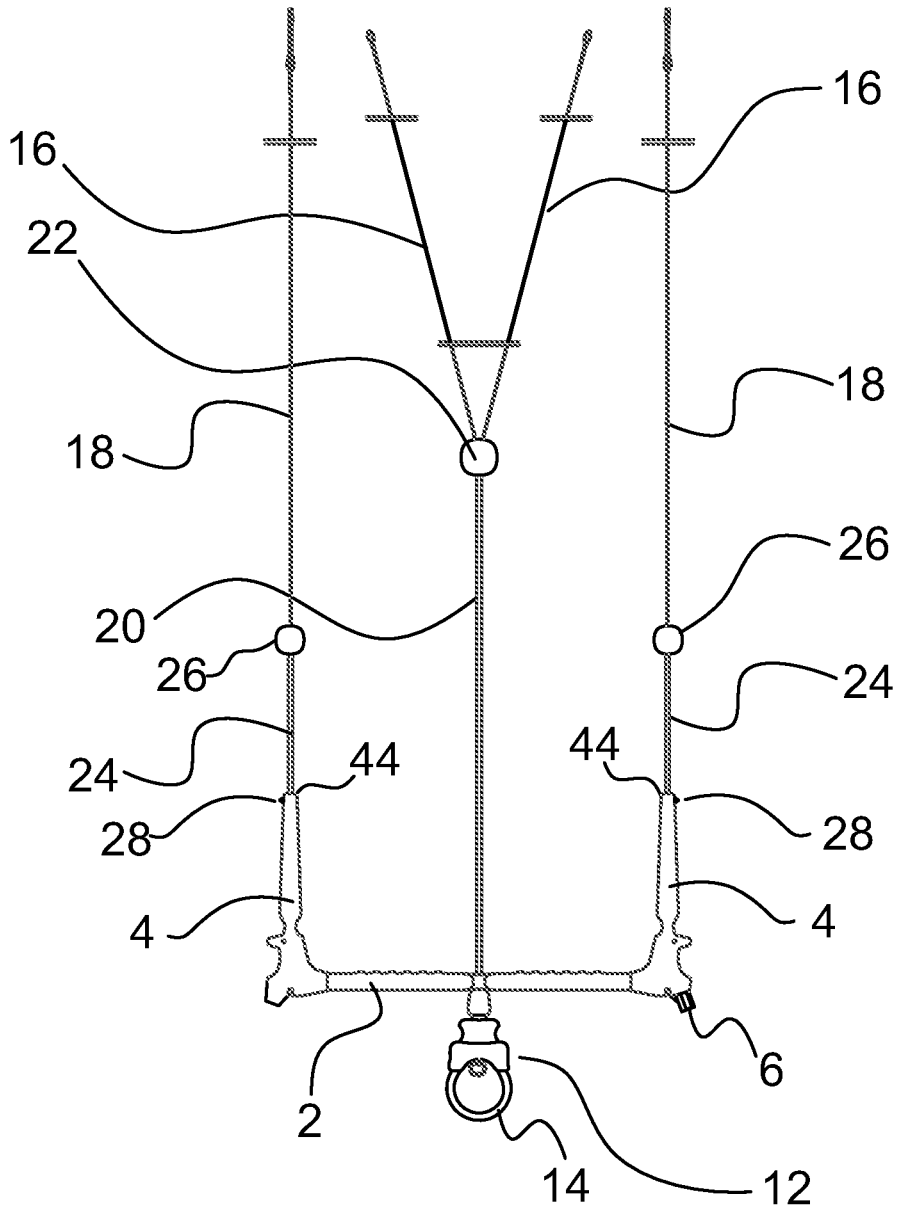
FIG. 1 is a rear elevation view of a kite control bar with trim adjustment means using a winder.

FIG. 1 is a rear elevation view of a kite control bar 2 with an integrated back trim line winder 6 that allows for the length adjustment of the back flying lines 18. Winding or unwinding the winder 6 shortens or lengthens the back trim line 24, which is connected to the back flying lines 18 via a back trim line to back flying line connection 26. The back trim line 24 exits the control bar 2 at the top of the bar end float 44. A tensioning member 28, located in the bar end float 4, tensions the back trim line 24 so that when the length of the back trim line 24 is increased, the excess length is forced out of the top of the bar end float 44. The front flying lines 16 transition into a front power line 20, with a bar stopper 22 at the transition point. The front power line 20 passes through the control bar 2 and then terminates at the front line connection assembly 12. The front line connection assembly 12 has a connection loop 14 that attaches to a harness worn by the user.

Figure 2:
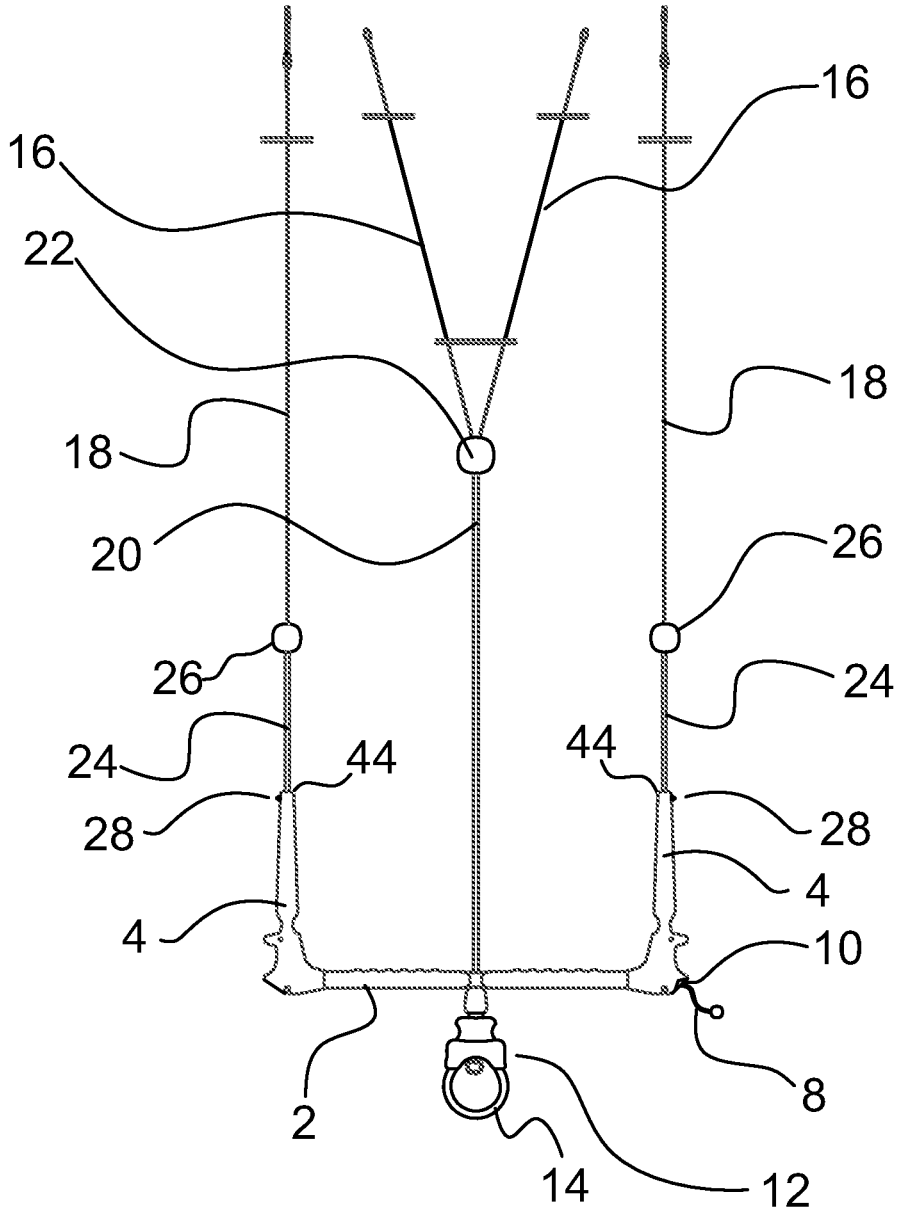
FIG. 2 is a rear elevation view of a kite control bar with trim adjustment means using a cleat.

FIG. 2 is a rear elevation view of a kite control bar 2 with an integrated back line trim rope 8 and trim cleat 10 that allows for the length adjustment of the back flying lines 18. Cleating or uncleating the back line trim rope 8 shortens or lengthens the back trim line 24, which is connected to the back flying lines 18 via a back trim line to back flying line connection 26. The back trim line 24 exits the control bar 2 at the top of the bar end float 44. A tensioning member 28, located in the bar end float 4, tensions the back trim line 24 so that when the length of the back trim line 24 is increased, the excess length is forced out of the top of the bar end float 44. The front flying lines 16 transition into a front power line 20, with a bar stopper 22 at the transition point. The front power line 20 passes through the control bar 2 and then terminates at the front line connection assembly 12. The front line connection assembly 12 has a connection loop 14 that attaches to a harness worn by the user.

Figure 3:
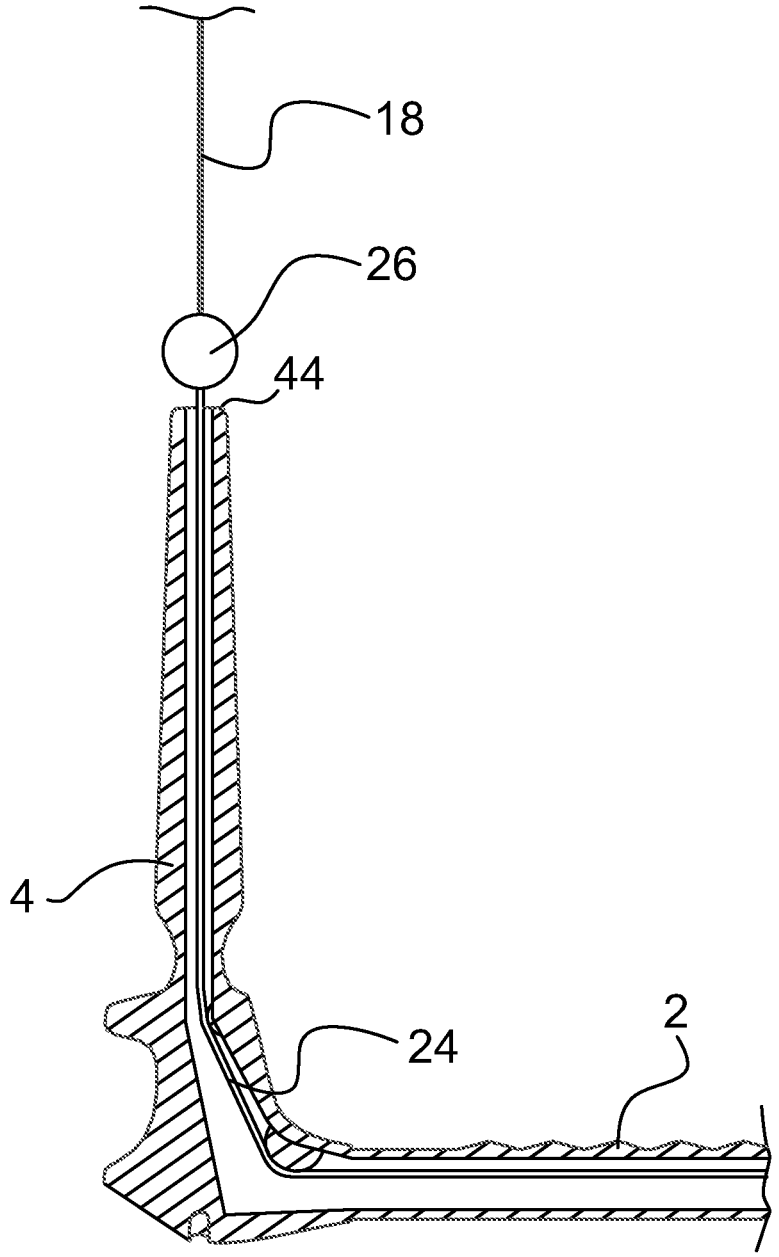
FIG. 3, labelled as PRIOR ART, is a detailed section view of a kite control bar without a tensioning member.
Figure 4:
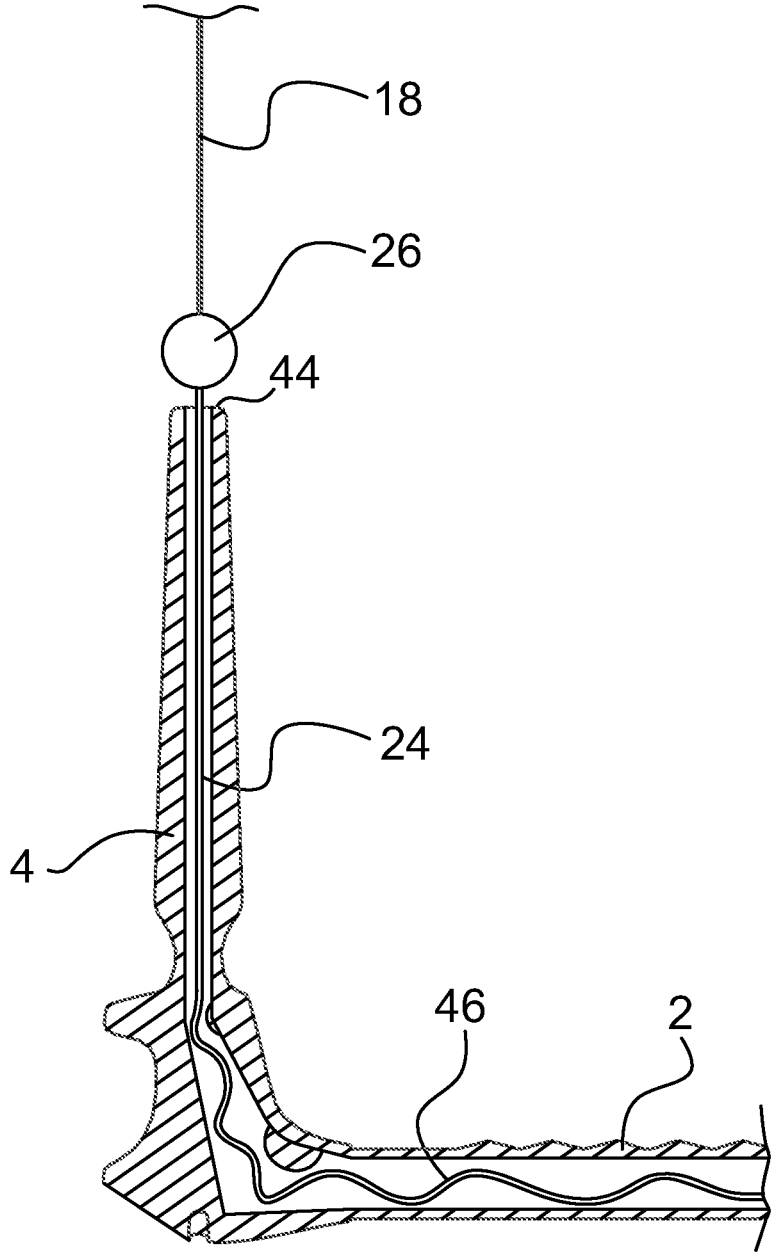
FIG. 4, labelled as PRIOR ART, is a detailed section view of a kite control bar of FIG. 3, when the trim line is released after trim line adjustment.

Before describing tensioning member 28, the Prior Art will first be described with reference to FIG. 3 and FIG. 4. FIG. 3 is a front cross sectional view showing the control bar 2 and bar end float 4, without a tensioning member 28 and the back trim line 24 shortened. The back trim line 4 extends through the control bar 2, bar end float 4 and the exits at the top of the bar end float 44. The back trim line 24 connects to the back flying line 18 at the back trim line to back flying line connection 26. This drawing shows that when the back trim line 24 is shortened, the back trim line to back flying line connection 26 is located close to the top of the bar end float 44. FIG. 4 is a front cross sectional view showing the control bar 2 and bar end float 4, without a tensioning member 28, as shown in FIG. 3, with the back trim line 24 lengthened and no load on the back flying lines 18. The back trim line 4 extends through the control bar 2, bar end float 4 and the exits at the top of the bar end float 44. The back trim line 24 connects to the back flying line 18 at the back trim line to back flying line connection 26. This drawing shows how when the back trim line 24 is lengthened, without a tensioning member 28 and with no load on the back flying lines 18, the excess back trim line 46 gathers inside the control bar 2 and bar end float 4. The back trim line to back flying line connection 26 remains close to the top of the bar end float 44.

Structure and Relationship of Parts:

In each embodiment, there is provided a kite control bar 2 having a hollow bar end float 4 through which a trim line 24 passes. A tensioning member 28 is anchored to the bar end float 4 and secured to the trim line 24. The tensioning member 28 is capable of expanding and contracting. The tensioning member 28 has a default state which is either an expanded state or a contracted state. When an adjusting force upon trim line 24 draws the tensioning member 28 into another of the expanded state or the contracted state, the tensioning member 28 tends to return to the default state when the force is released. This biases the trim line 24 to force excess trim line 24 out of the bar end float 4.

Figure 5:
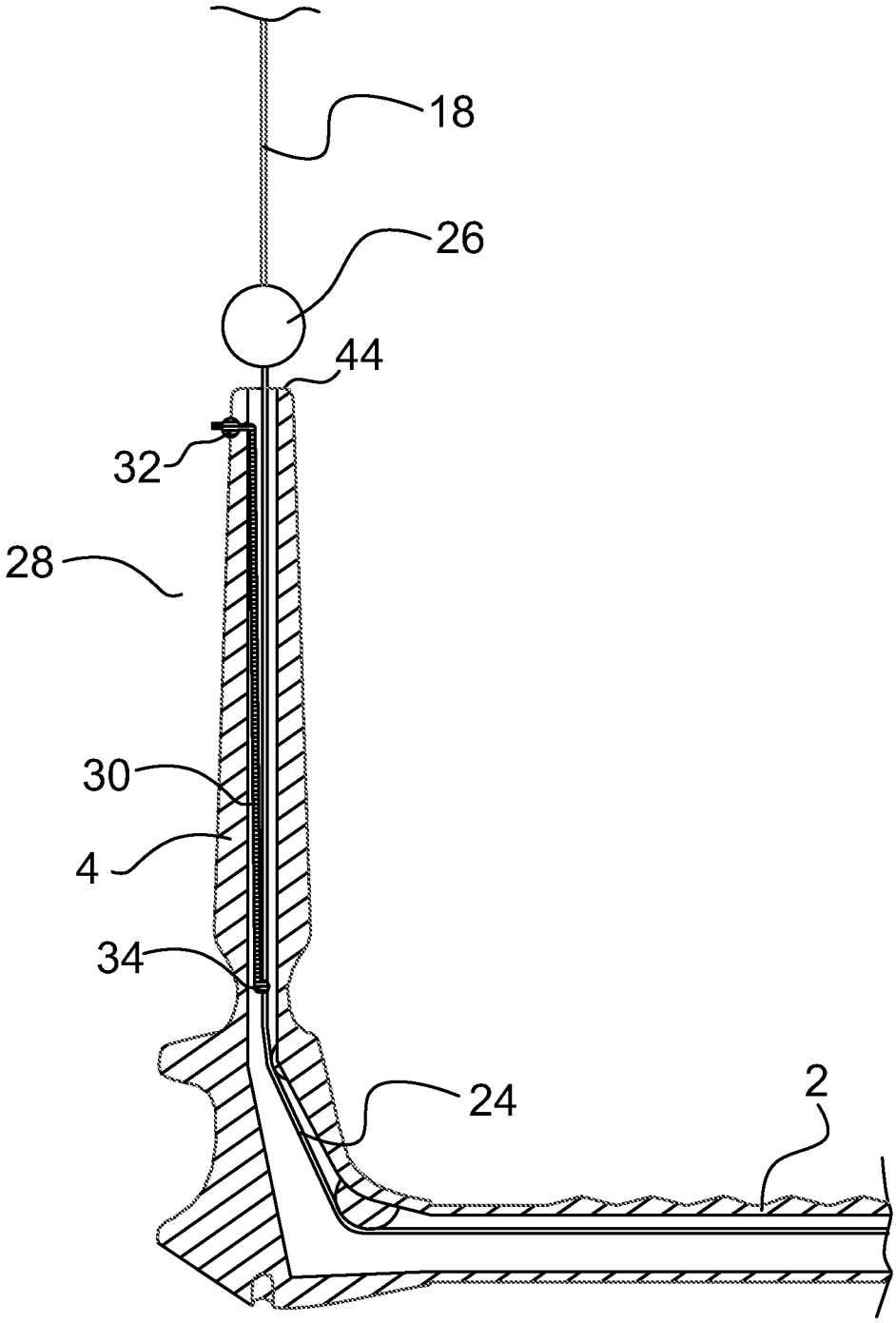
FIG. 5 is a detailed section view of a first embodiment of a kite control bar with tensioning member in a first position.
Figure 6:
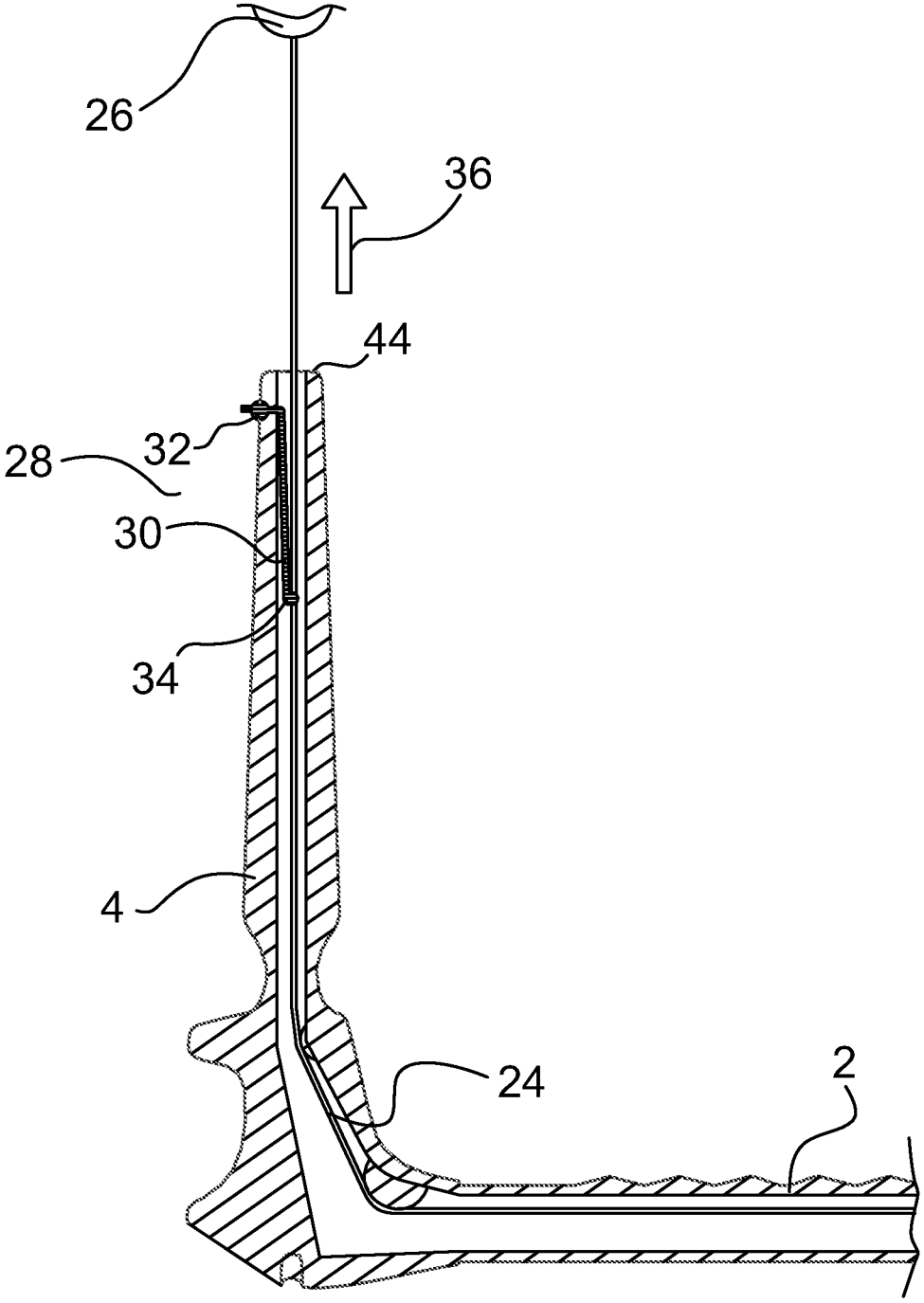
FIG. 6 is a detailed section view of the first embodiment of kite control bar of FIG. 5, with tensioning member in a second position.

There will hereinafter be described various embodiments of tensioning member 28. The first embodiment of tensioning member 28 illustrated in FIG. 5 and FIG. 6 discloses a tensioning member 28 in the form of an elastomeric shock cord 30. Referring to FIG. 6, the default state for the elastomeric shock cord 30 is a contracted state. Referring to FIG. 5, when the trim line 24 is adjusted, the elastomeric shock cord 30 is drawn into an expanded state. Referring to FIG. 6, when the elastomeric shock cord 30 returns to the contracted state the biasing force on the trim line 24 forces excess trim line 24 out of the bar end float 4. It will be appreciated that a tension spring could be made to function in a like manner to elastomeric shock cord 30.

Figure 7:
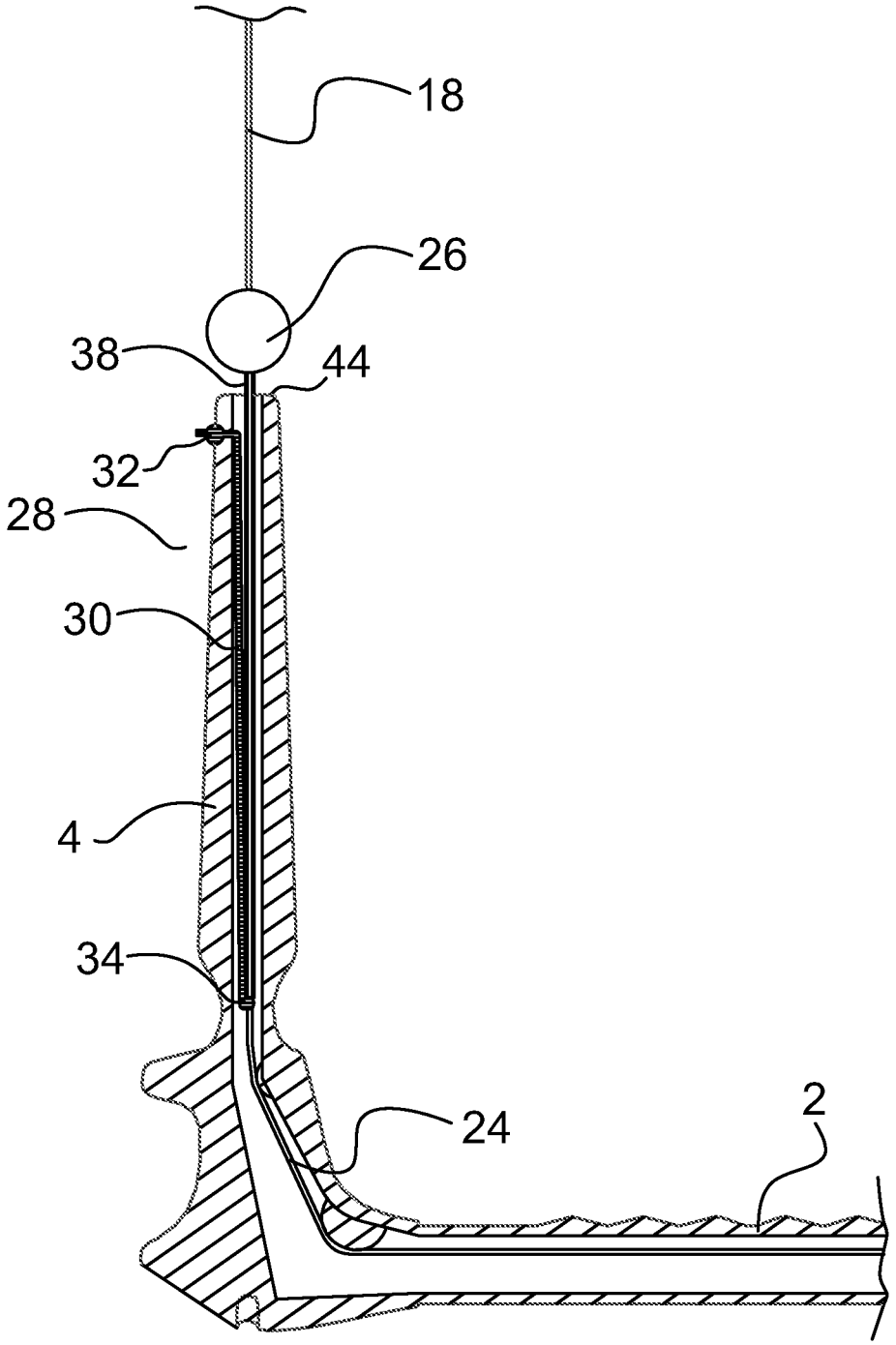
FIG. 7 is a detailed section view of a second embodiment of a kite control bar with tensioning member in a first position.
Figure 8:
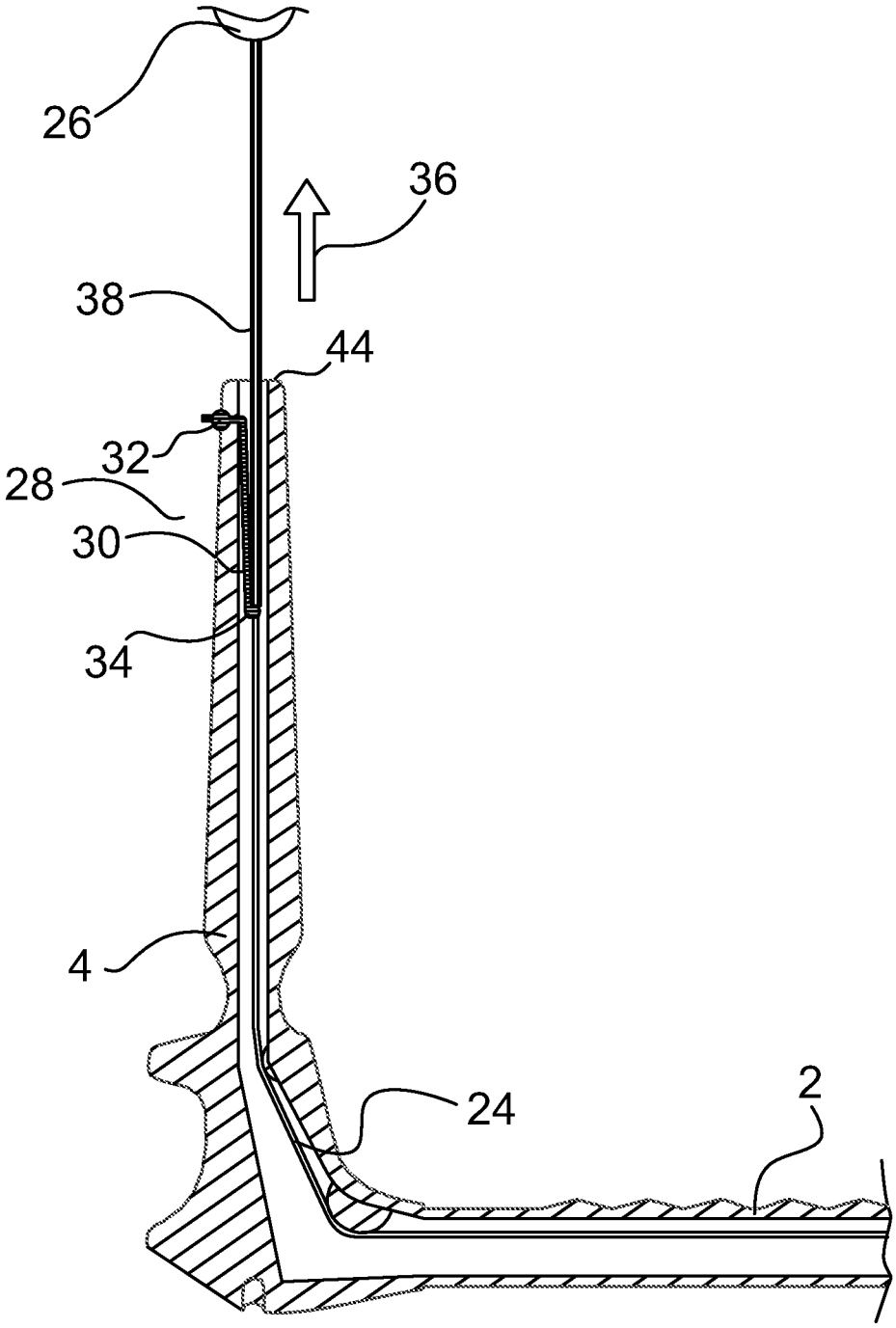
FIG. 8 is a detailed section view of the second embodiment of kite control bar of FIG. 7, with tensioning member in a second position.

In the second embodiment of tensioning member 28 illustrated in FIG. 7 and FIG. 8, a portion of trim line 24 is encased in a length of plastic tubing 38. Plastic tubing 38 serves to protect trim line 24 against chaffing during adjustment. The second embodiment functions in a similar manner to the first embodiment. Tensioning member 28 is in the form of an elastomeric shock cord 30. Referring to FIG. 8, the default state for the elastomeric shock cord 30 is a contracted state. Referring to FIG. 7, when the trim line 24 is adjusted the elastomeric shock cord 30 is drawn into an expanded state. Referring to FIG. 8, when the elastomeric shock cord 30 returns to the contracted state the biasing force on the trim line 24 forces excess trim line 24 out of the bar end float 4.

Figure 9:
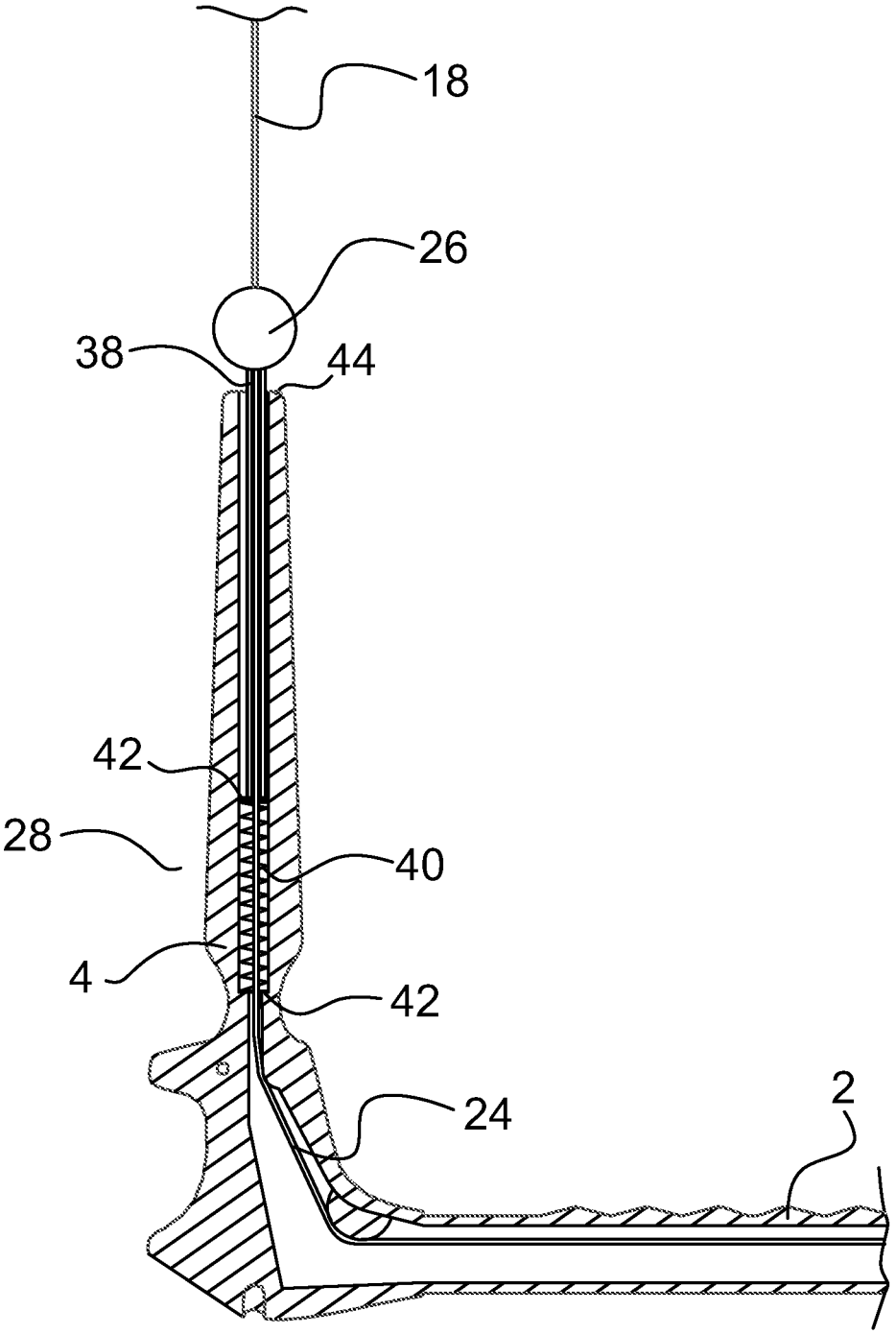
FIG. 9 is a detailed section view of a third embodiment of a kite control bar with tensioning member in a first position.
Figure 10:
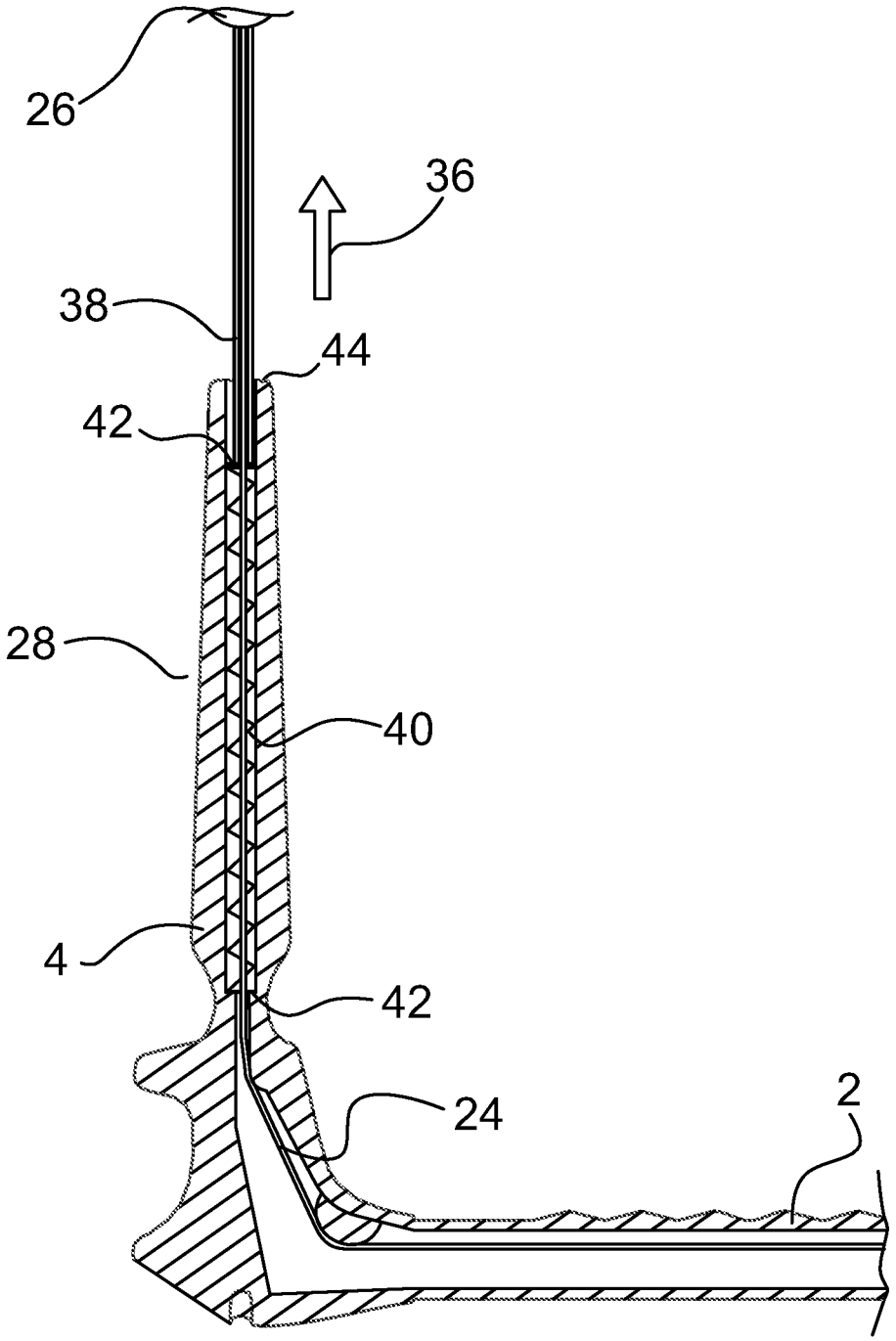
FIG. 10 is a detailed section view of the third embodiment of kite control bar of FIG. 9, with tensioning member in a second position.

The third embodiment of tensioning member 28 illustrated in FIG. 9 and FIG. 10 discloses a tensioning member in the form of a compression spring 40 and a portion of trim line 24 is encased in a length of plastic tubing 38. Referring to FIG. 10, the default state for the compression spring 40 is an expanded state. Referring to FIG. 9, an adjusting force upon the trim line 24 compresses the compression spring 40 into a contracted state. Referring to FIG. 10, when the adjusting force is released, the compression spring 40 returns to the expanded state forcing excess trim line 24 out of the bar end float 4.

Figure 11:
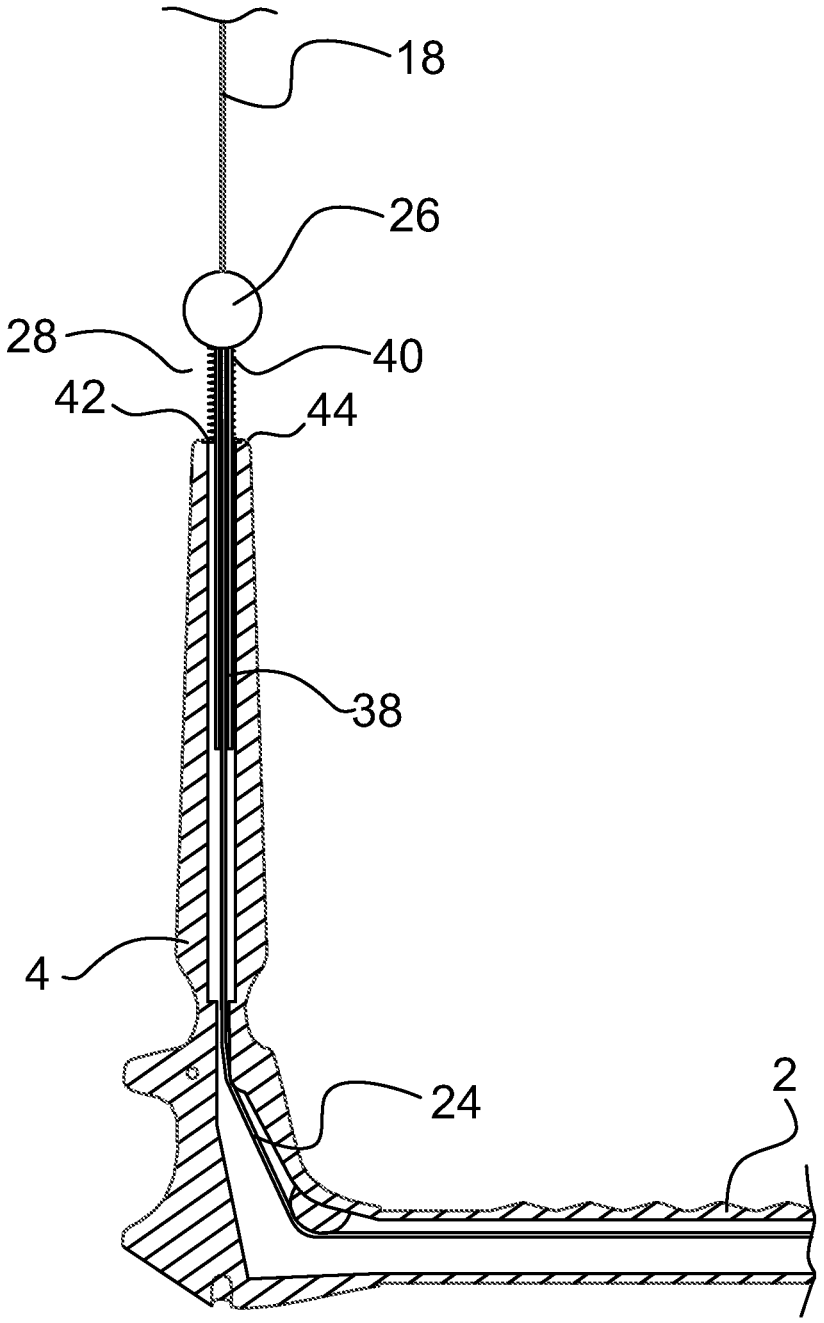
FIG. 11 is a detailed section view of a fourth embodiment of a kite control bar with tensioning member in a first position.
Figure 12:
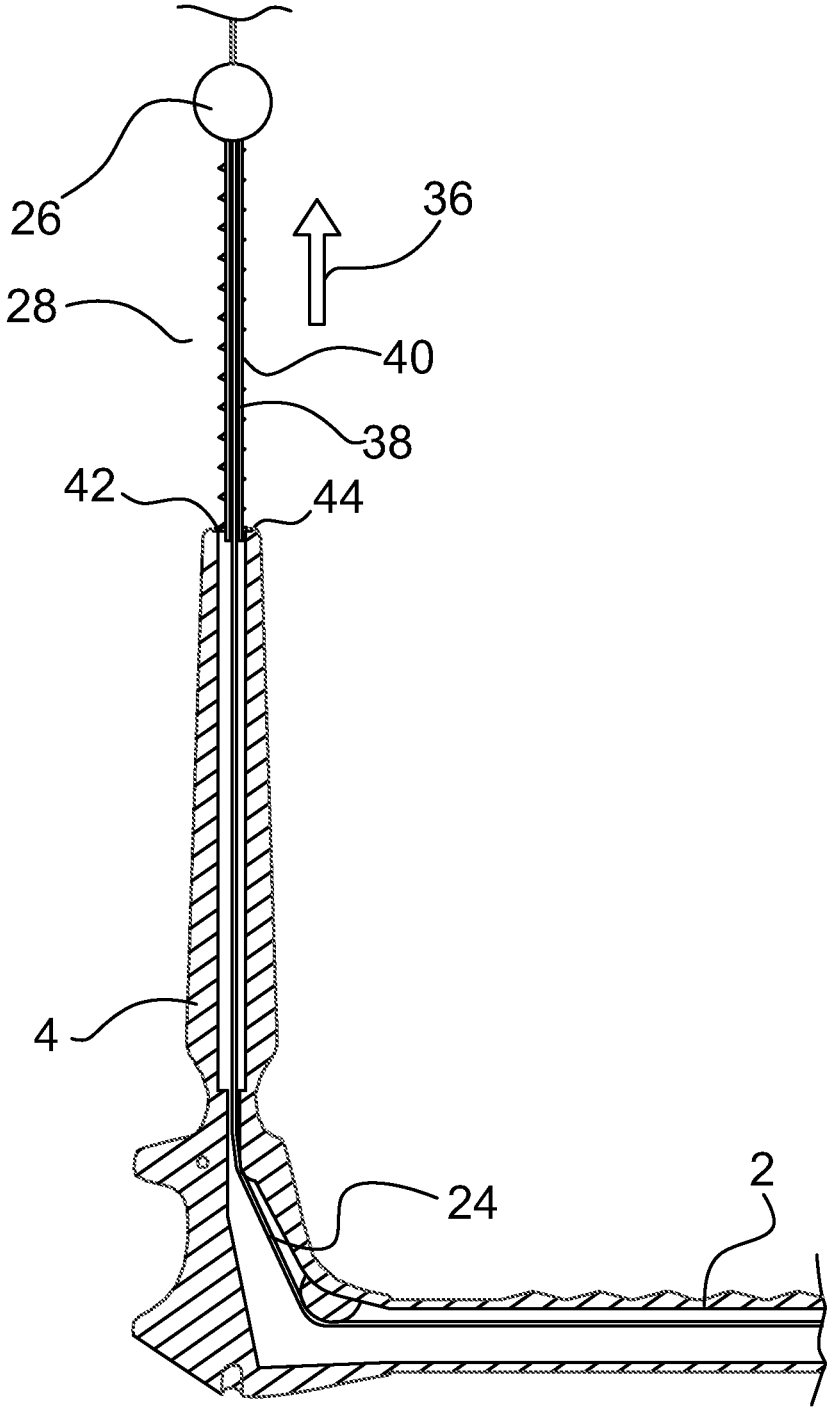
FIG. 12 is a detailed section view of the fourth embodiment of kite control bar of FIG. 11, with tensioning member in a second position.

In the fourth embodiment of tensioning member illustrated in FIG. 11 and FIG. 12, compression spring 40 is positioned externally of bar end float 4. This fourth embodiment functions in a similar manner to the third embodiment. Referring to FIG. 12, the default state for the compression spring 40 is an expanded state. Referring to FIG. 11, an adjusting force upon the trim line 24 compresses the compression spring 40 into a contracted state. Referring to FIG. 12, when the adjusting force is released the compression spring 40 returns to the expanded state forcing excess trim line 24 out of the bar end float 4.

Figure 13:
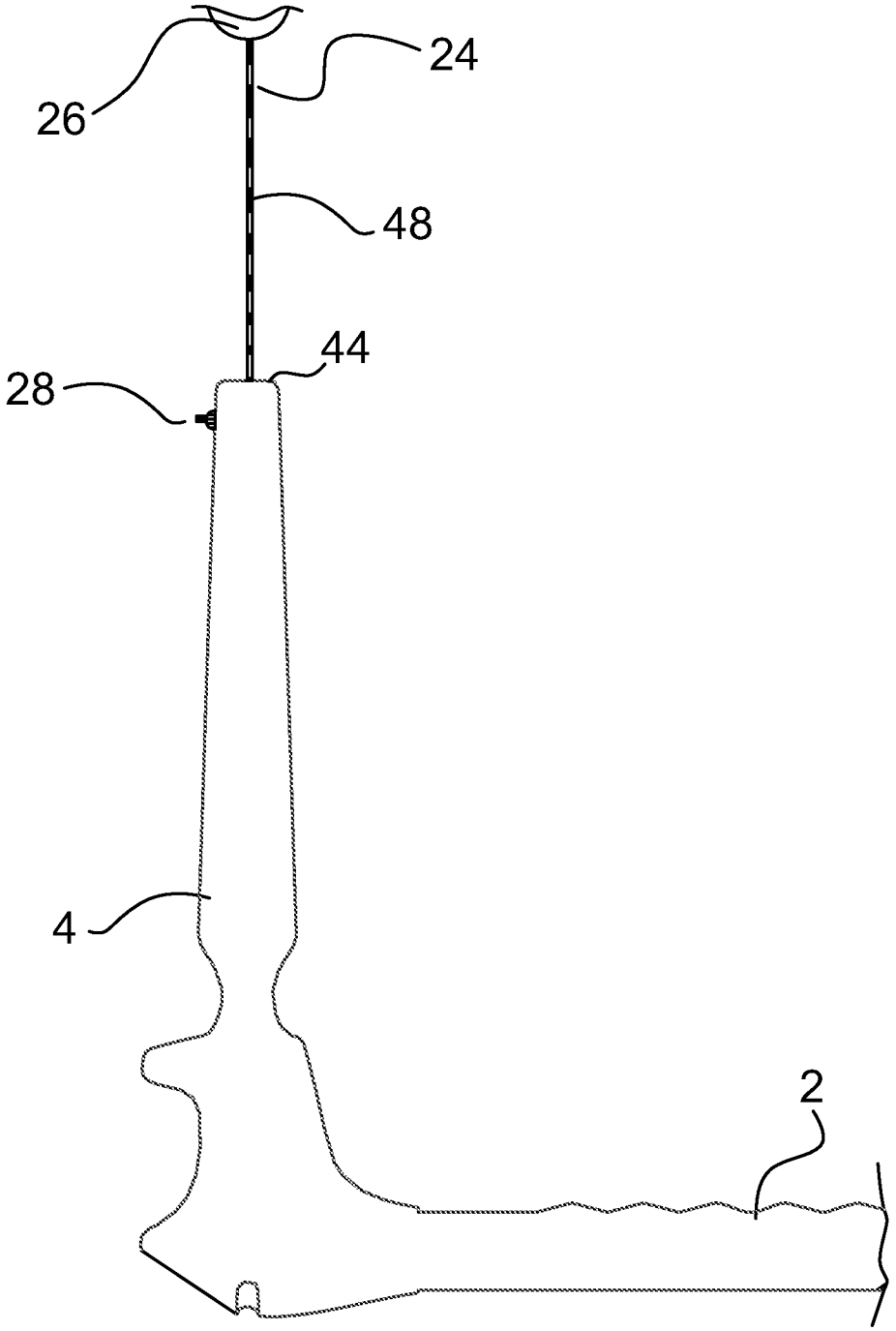
FIG. 13 is a detailed rear elevation view of a fifth embodiment of a kite control bar with tensioning member.

The fifth embodiment of tensioning member illustrated in FIG. 13 discloses modified version of FIG. 6, with the back trim line 24 having calibration markings 48 that enable the user to visually gauge the trim setting.

Figure 14:
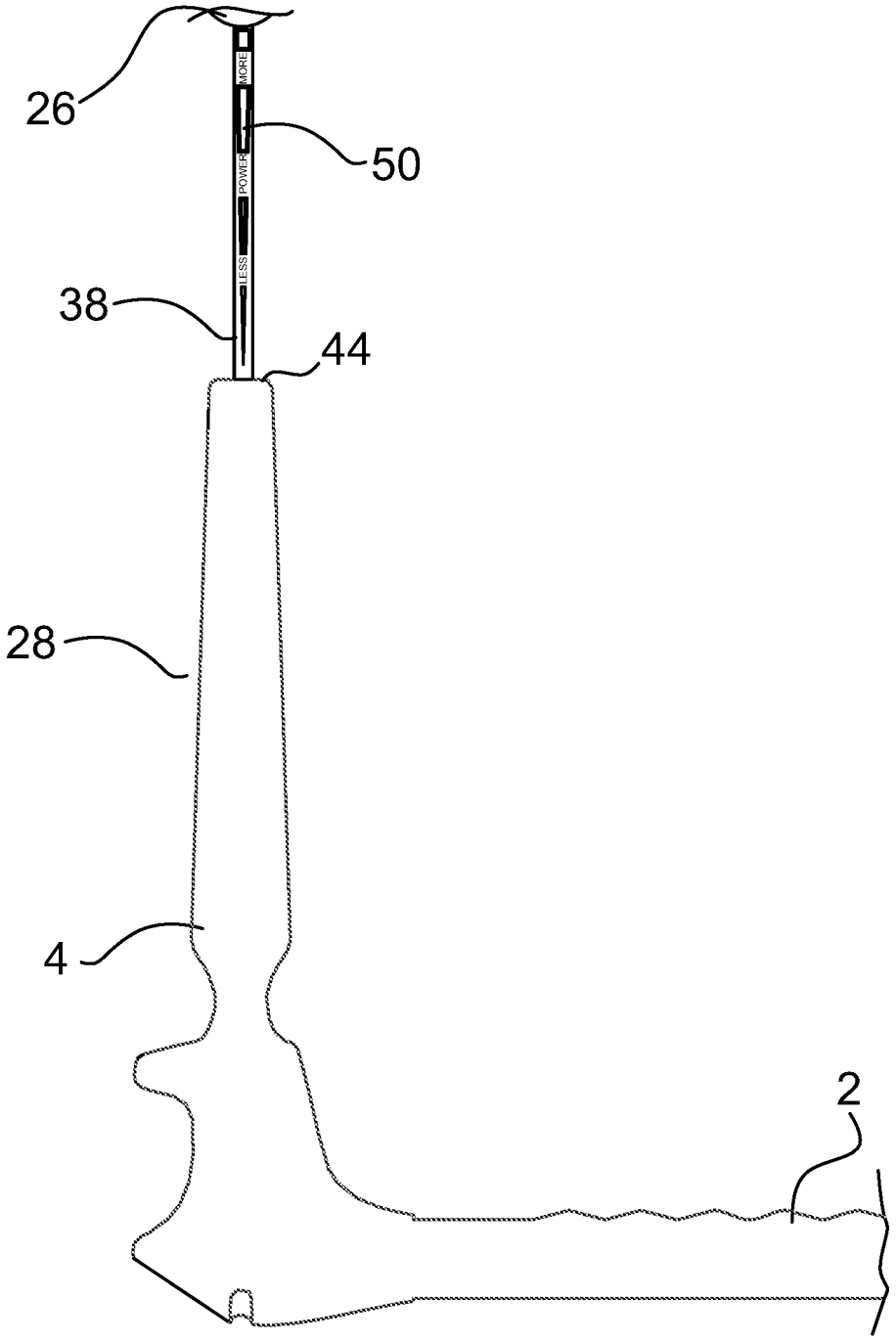
FIG. 14 is a detailed rear elevation view of a sixth embodiment of a kite control bar with tensioning member.

The sixth embodiment of tensioning member illustrated in FIG. 14 discloses modified version of FIG. 8, with the plastic tubing 38 having calibration markings 50 that enable the user to visually gauge the trim setting.

The various embodiments will now be described in greater detail. FIG. 5 is a front cross sectional view showing the control bar 2 and bar end float 4, with a tensioning member 28 and the back trim line 24 shortened. The back trim line 24 extends through the control bar 2, bar end float 4 and the exits at the top end 44 of the bar end float 4. The back trim line 24 connects to the back flying line 18 at the back trim line 24 to back flying line connection 26. The tensioning member 28 is an elastomeric material such as a length of shock cord 30. One end of the shock cord 30 is attached near the top end 44 of the bar end float 4 with a shock cord to bar end float connection 32, and the other end of the shock cord 30 is attached to the back trim line 24 at a shock cord to back trim line connection 34. This drawing shows how when the back trim line 24 is shortened, the shock cord 30 is stretched thus putting a tension force onto the back trim line 24. The back trim line to back flying line connection 26 is close to the top end 44 of the bar end float 4.

FIG. 6 is a front cross sectional view showing the control bar 2 and bar end float 4, with a tensioning member 28, as shown in FIG. 5, with the back trim line 24 lengthened and no load on the back flying lines 18. The back trim line 24 extends through the control bar 2, bar end float 4 and the exits at the top end 44 of the bar end float 4. The back trim line 24 connects to the back flying line 18 at the back trim line to back flying line connection 26. The tensioning member 28 is an elastomeric material such as a length of shock cord 30. One end of the shock cord 30 is attached near the top end 44 of the bar end float 4 with a shock cord to bar end float connection 32, and the other end of the shock cord 30 is attached to the back trim line 24 at a shock cord to back trim line connection 34. This drawing shows how when the back trim line 24 is lengthened, the shock cord 30 retracts thus putting a tension force onto the back trim line 24. The back trim line 24 is forced out of the top end 44 of the bar end float 4 and so the back trim line to back flying line connection 26 is pushed away from the top end 44 of the bar end float 4. Arrow 36 shows the direction of movement of the back trim line 24.

Variations:

FIG. 7 is a front cross sectional view showing the control bar 2 and bar end float 4, with a second embodiment of the tensioning member 28 and the back trim line 24 shortened. The back trim line 4 extends through the control bar 2, bar end float 4 and the exits at the top end 44 of the bar end float 4. The back trim line 24 connects to the back flying line 18 at the back trim line to back flying line connection 26. The tensioning member 28 is an elastomeric material such as a length of shock cord 30. One end of the shock cord 30 is attached near the top end 44 of the bar end float 4 with a shock cord to bar end float connection 32, and the other end of the shock cord 30 is attached to the back trim line 24 at a shock cord to back trim line connection 34. The back trim line 24, between the shock cord to back trim line connection 34 and the back trim line to back flying line connection 26, is encased in a length of plastic tubing 38. This drawing shows how when the back trim line 24 is shortened, the shock cord 30 is stretched thus putting a tension force onto the back trim line. The back trim line to back flying line connection 26 is close to the top of the bar end float 44.

FIG. 8 is a front cross sectional view showing the control bar 2 and bar end float 4, with second embodiment of the tensioning member 28, as shown in FIG. 7, with the back trim line 24 lengthened and no load on the back flying lines 18. The back trim line 24 extends through the control bar 2, bar end float 4 and the exits at the top end 44 of the bar end float 4. The back trim line 24 connects to the back flying line 18 at the back trim line to back flying line connection 26. The tensioning member 28 is an elastomeric material such as a length of shock cord 30. One end of the shock cord 30 is attached near the top end 44 of the bar end float 4 with a shock cord to bar end float connection 32, and the other end of the shock cord 30 is attached to the back trim line 24 at a shock cord to back trim line connection 34. The back trim line 24, between the shock cord to back trim line connection 34 and the back trim line to back flying line connection 26, is encased in a length of plastic tubing 38. This drawing shows how when the back trim line 24 is lengthened, the shock cord 30 retracts thus putting a tension force onto the back trim line 24. The plastic tubing 38 transfers the retraction force of the shock cord 30 at the shock cord to back trim line connection 34 to the back trim line to back flying line connection 26 thus the back trim line 24 is forced out of the top end 44 of the bar end float 4 and so the back trim line to back flying line connection 26 is pushed away from the top end 44 of the bar end float 4. Arrow 36 shows the direction of movement of the back trim line 24.

FIG. 9 is a front cross sectional view showing the control bar 2 and bar end float 4, with a third embodiment of the tensioning member 28 and the back trim line 24 shortened. The back trim line 24 extends through the control bar 2, bar end float 4 and then exits at the top end 44 of the bar end float 4. The back trim line 24 connects to the back flying line 18 at the back trim line to back flying line connection 26. The tensioning member 28 is a compression spring 40. The lower end of the compression spring 40 bears against a bearing plate 42 that is located at the base of the bar end float 4 and the upper end of the compression spring 40 bears against a bearing plate 42, which is positioned at the base of a section of plastic tubing 38. The back trim line 24 runs through the compression spring 40, bearing plates 42 and the plastic tubing 38. This drawing shows how when the back trim line 24 is shortened, the compression spring 40 is compressed between the bearing plates 42 thus putting a tension force onto the back trim line. The back trim line to back flying line connection 26 is close to the top end 44 of the bar end float 4.

FIG. 10 is a front cross sectional view showing the control bar 2 and bar end float 4, with third embodiment of the tensioning member 28, as shown in FIG. 9, with the back trim line 24 lengthened and no load on the back flying lines 18. The back trim line 24 extends through the control bar 2, bar end float 4 and then exits at the top end 44 of the bar end float 4. The back trim line 24 connects to the back flying line 18 at the back trim line to back flying line connection 26. The tensioning member 28 is a compression spring 40. The lower end of the compression spring 40 bears against a bearing plate 42 that is located at the base of the bar end float 4 and the upper end of the compression spring bears against a bearing plate 42, which is positioned at the base of a section of plastic tubing 38. The back trim line 24 runs through the compression spring 40, bearing plates 42 and the plastic tubing 38. This drawing shows how when the back trim line 24 is lengthened, the compression spring 40 expands, thus putting a tension force onto the back trim line 24. The plastic tubing 38 transfers the expansion force of the spring 40 to the back trim line to back flying line connection 26 thus the back trim line 24 is forced out of the top end 44 of the bar end float 4 and so the back trim line to back flying line connection 26 is pushed away from the top end 44 of the bar end float 4. Arrow 36 shows the direction of movement of the back trim line 24.

FIG. 11 is a front cross sectional view showing the control bar 2 and bar end float 4, with fourth embodiment of the tensioning member 28 and the back trim line 24 shortened. The back trim line 24 extends through the control bar 2, bar end float 4 and then exits at the top end 44 of the bar end float 4. The back trim line 24 connects to the back flying line 18 at the back trim line to back flying line connection 26. The tensioning member 28 is a compression spring 40 that is positioned externally at the top end 44 of the bar end float 4. The lower end of the compression spring 40 bears against a bearing plate 42 that is located at the top end 44 of the bar end float 4 and the upper end of the compression spring 40 bears against the back trim line to the back flying line connection 26. The back trim line 24 runs through the compression spring 40 and bearing plate 42. This drawing shows how when the back trim line 24 is shortened, the compression spring 40 is compressed between the bearing plate 42 and the back trim line to back flying line connection 26 thus putting a tension force onto the back trim line. The back trim line to back flying line connection 26 is close to the top end 44 of the bar end float 4.

FIG. 12 is a front cross sectional view showing the control bar 2 and bar end float 4, with fourth embodiment of the tensioning member 28, as shown in FIG. 11, with the back trim line 24 lengthened and no load on the back flying lines 18. The back trim line 24 extends through the control bar 2, bar end float 4 and then exits at the top end 44 of the bar end float 4. The back trim line 24 connects to the back flying line 18 at the back trim line to back flying line connection 26. The tensioning member 28 is a compression spring 40 that is positioned externally at the top end 44 of the bar end float 4. The lower end of the compression spring 40 bears against a bearing plate 42 that is located at the top end 44 of the bar end float 4 and the upper end of the compression spring 40 bears against the back trim line to the back flying line connection 26. The back trim line 24 runs through the compression spring 40 and bearing plate 42. This drawing shows how when the back trim line 24 is lengthened, the compression spring 40 expands between the bearing plate 42 and the back trim line to back flying line connection 26 thus putting a tension force onto the back trim line 24 and so the back trim line to back flying line connection 26 is pushed away from the top end 44 of the bar end float 4. Arrow 36 shows the direction of movement of the back trim line 24.

FIG. 13 is a front view of a kite control bar 2 and bar end float 4 with a fifth embodiment of tensioning member 28. Back trim line 24 exits bar end float 4 at the top end 44 of the bar end float 4 and extends to back trim line to back flying line connection 26. This is a modified version of FIG. 6, with the back trim line 24 having calibration markings 48 that enable the user to visually gauge the trim setting.

FIG. 14 is a front view of kite control bar 2 and bar end float 4 with a sixth embodiment of tensioning member 28. Plastic tubing 38 exits bar end float 4 at the top end 44 of the bar end float 4 and extends to back trim line to back flying line connection 26. This is a modified version of FIG. 8, with the plastic tubing 38 having calibration markings 50 that enable the user to visually gauge the trim setting.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A kite control bar having a bar end float through which a trim line passes, comprising:

an elongated tensioning member directly anchored to the bar end float and secured to the trim line, the tensioning member expands and contracts, the tensioning member having a default state which is either an expanded state or a contracted state, when an adjusting force is exerted upon the trim line the tensioning member is drawn into another of the expanded state or the contracted state, the tensioning member tending to return to the default state when the adjusting force is released, thereby biasing the trim line to force excess trim line out of the bar end float.

2. The kite control bar of claim 1, wherein the tensioning member is located within the bar end float.

3. The kite control bar of claim 1, wherein the default state for the tensioning member is the contracted state, when the trim line is adjusted the tensioning member is drawn into the expanded state and when the tensioning member returns to the contracted state the biasing force on the trim line forces excess trim line out of the bar end float.

4. The kite control bar of claim 3, wherein the tensioning member is an elastomeric cord.

5. The kite control bar of claim 1, wherein the tensioning member is a spring.

6. The kite control bar of claim 1, wherein the default state for the tensioning member is the expanded state, an adjusting force upon the trim line draws the tensioning member into a contracted state and when the adjusting force is released the tensioning member returns to the expanded state forcing excess trim line out of the bar end float.

7. The kite control bar of claim 6, wherein the tensioning member is a compression spring.

8. The kite control bar of claim 1, wherein the tensioning member is located externally of the bar end float.

9. The kite control bar of claim 1, wherein there are calibrated markings on the trim line that are visible as the trim line exits the bar end float, the calibrated markings indicating trim line positioning.

10. The kite control bar of claim 1, wherein a plastic tube overlies the trim line.

11. The kite control bar of claim 10, wherein there are calibrated markings on the plastic tube that overlies the trim line, the calibrated markings being visible as the trim line exits the bar end float, the calibrated markings indicating trim line positioning.

* * * * *